US005384019A

United States Patent [19]

Keating et al.

[11] Patent Number: 5,384,019

[45] Date of Patent: Jan. 24, 1995

[54] MEMBRANE REINFORCED WITH MODIFIED LENO WEAVE FABRIC

[75] Inventors: James T. Keating, Wilmington, Del.; Everett I. Baucom, Fayetteville, N.C.; James M. Batman, Andreas, Pa.

[73] Assignee: E. I. du Pont de Nemours and Company, Wilmington, Del.

[21] Appl. No.: 144,861

[22] Filed: Oct. 29, 1993

[51] Int. Cl.[6] ..... C25B 13/08; C25B 13/02

[52] U.S. Cl. ..... 204/252; 521/27; 521/28; 204/296

[58] Field of Search ..... 204/296, 252; 521/27, 521/28

[56] References Cited

U.S. PATENT DOCUMENTS

| | | | |
|---|---|---|---|
| 3,770,567 | 11/1973 | Grot | 161/189 |
| 3,849,243 | 11/1974 | Grot | 161/189 |
| 3,902,947 | 9/1975 | Grot | 156/213 |
| 3,925,135 | 12/1975 | Grot | 156/213 |
| 4,072,793 | 2/1978 | Watanabe et al. | 428/255 |
| 4,341,605 | 7/1982 | Solenberger et al. | 204/98 |
| 4,437,951 | 3/1984 | Bissot et al. | 204/98 |
| 4,552,631 | 11/1985 | Bissot et al. | 204/98 |
| 4,650,551 | 3/1987 | Carl et al. | 204/59 R |
| 4,778,723 | 10/1988 | Carl et al. | 428/394 |
| 4,913,817 | 4/1990 | Tsushima et al. | 210/500.27 |
| 4,964,960 | 10/1990 | Keating et al. | 204/98 |
| 4,996,098 | 2/1991 | Perusich et al. | 428/229 |
| 5,004,648 | 4/1991 | Hane et al. | 428/364 |

*Primary Examiner*—Kathryn Gorgos
*Attorney, Agent, or Firm*—Cary A. Levitt

[57] ABSTRACT

An ion exchange membrane reinforced with leno weave yarn system having sacrificial fibers paired with resistant fibers in the warp of the fabric, and an electrolysis process using the membrane are disclosed.

14 Claims, 2 Drawing Sheets

MEMBRANE REINFORCED WITH MODIFIED LENO WEAVE FABRIC

FIELD OF INVENTION

The present invention relates to chemically resistant reinforced ion exchange membranes and their use as separators in electrolytic cells.

BACKGROUND OF THE INVENTION

Alkali metal chlorides, such as sodium chloride (NACl) and potassium chloride (KCl), are commercially electrolyzed using cation exchange membranes to make chlorine and either sodium hydroxide (NaOH) or potassium hydroxide (KOH). The state-of-the-art process for such a chloralkali electrolysis is membrane electrolysis, in which a non-porous membrane, typically a fluorocarbon membrane, separates the anode chamber and the cathode chamber. The use of a fluorinated ion exchange membrane as a means for separating the anode and cathode compartments of a fuel cell or an electrolytic cell, especially a chloralkali electrolytic cell, is well known. In an electrolytic cell, it is desired that the ion exchange membrane exhibit low cell voltage and high current efficiency, thereby enabling the electrolytic cell to be stably operated with low electric power consumption. In a fuel cell, it is desired that the ion exchange membrane exhibit high ionic conductivity, thereby enabling the fuel cell to be stably operated with high electric power output. Membranes are commonly reinforced with a chemical-resistant fabric to improve tear strength, burst strength and dimensional stability.

However, use of reinforcement within the membrane is not totally beneficial. One deleterious effect is that use of reinforcement such as fabric results in a thicker membrane, which in turn leads to operation at higher voltage because the greater membrane thickness has a higher electrical resistance.

In order to obtain a low cell voltage in a chloralkali cell along with good stability for handling the reinforcing fabric and the reinforced membrane, it is desirable to have an open reinforcing fabric and a thin membrane. A thin membrane requires a thin fabric and a small total thickness of the film layers used in laminating the reinforced ion exchange resin.

Efforts to lower the resistance by using thinner films in fabricating reinforced membranes are often unsuccessful because the film ruptures in some of the windows of the fabric during membrane fabrication, resulting in a membrane with leaks. ("Windows" means the open areas of a fabric between adjacent threads of fabric.) A membrane which leaks is undesirable as it permits anolyte and catholyte to flow into the opposite cell compartments, thereby lowering the current efficiency and contaminating the products made.

A second deleterious effect, which also leads to operation at higher voltage, is caused by a "shadowing" effect of the reinforcing members. The shortest path for an ion through a membrane is a straight perpendicular path from one surface to the other surface. Reinforcement members are uniformly fabricated of substance which is not ion-permeable. Those parts of a membrane where an ion cannot travel perpendicularly straight through a membrane, and from which the ion must take a circuitous path around a reinforcing member, are termed "shadowed areas". Introduction of shadowed areas into a membrane by use of reinforcement in effect leads to a reduction in the portion of the membrane which actively transports ions, and thus increases the operating voltage of the membrane. That part of the shadowed area of a membrane which is adjacent to the downstream side of the reinforcement members, "downstream" referring to the direction of the positive ion flux through the membrane, is termed the "blind area".

An open fabric is one in which the area of the fabric is at least about 150%, and preferably 200% or more, greater than the area of the permanent reinforcing yarns. In other words, it is a fabric with a large percentage of windows or open spaces and a small percentage of shadowed areas and blind spots. This is desirable because it is the open spaces which allow ions to readily pass during electrolysis. Thus, a more open fabric makes possible lower cell voltage and therefore a lower power consumption.

The simplest kind of fabric is one with a prior art plain weave, shown in FIG. 1. However, the yarns which comprise an open plain weave fabric tend to become disorderly and the fabric is not uniform. The resulting membrane may disadvantageously have non-uniform electrical properties across the membrane. In addition, the membrane may be susceptible to cracks, pinholes or wrinkling. In addition, if the fabric is made with high openness—a small number of yarns in each direction—the fabric lacks dimensional stability and may stretch out of shape. This is a serious problem during assembly of commercial electrolytic cells, particularly those which may require large membranes, some of which are as large as $1.5\times3.7$ meters (m), and those in which vertical assemble is employed.

In order to make a more open fabric with uniform open spaces than is feasible with a plain weave, considerable attention has been given to a leno weave fabric. A prior art leno weave is shown in FIG. 2. For example, U.S. Pat. No. 4,072,793 teaches the use of leno weave fabrics, including fabrics made from fibers of fluorocarbon polymer such as polytetrafluoroethylene ("PTFE"). However, as can be seen from FIG. 2, the fabric tends to be thick at the point where two warp yarns cross a filling yarn at about the same place, resulting in a triple cross-over point. It is also necessary to use fill yarns that are twice the denier of the warp yarns if the fabric is to have the same physical properties in both directions. Because fabric strength is not a limiting characteristic and 100 denier is presently the smallest PTFE commercially available, such leno weaves are stronger and thicker than necessary for their reinforcing function. Thick fabrics are generally considered undesirable because they require a large amount of polymer to cover the fabric on both sides of the membrane and cause large shadowed areas. If the yarn penetrates the surface of the membrane, it may cause leakage from one electrolyte to the other along voids that result because adhesion of the polymer to the yarn is imperfect. Leakage of the catholyte into the anolyte causes low current efficiency and high power consumption along with other problems. Leakage of anolyte into the catholyte may lead to amounts of chloride in the caustic product which exceed customer requirements.

Moreover, in leno weave the pairing of yarns in the warp tends to be imperfect and the windows in the membrane are not square. This disadvantageously increases the possibility of puckering of the membrane during operation, which may decrease the useful life of the membrane.

It is also possible to incorporate sacrificial fibers into the fabric. The sacrificial fibers provide mechanical strength and stability during handling of an ion exchange membrane, but may be removed during operation of the membrane so as to reduce interference with the transport properties of the membrane. The sacrificial yarns confer stability to an open (with respect to permanent, resistant yarns) plain weave fabric. The use of sacrificial fibers in cation exchange membranes is described in U.S. Pat. No. 4,437,951. Sacrificial yarns normally outnumber the permanent yarns 2–10:1 so they increase weaving time and material cost. In addition, sacrificial yarns undersirably leave channels in the membrane which cause leakage at the membrane edges, causing corrosion to the electrolytic cell and deterioration of the cell gasket. The channels may also be reservoirs of chlorinated brine which can cause cathode corrosion during shutdowns.

Therefore, there is needed a reinforced membrane which is flat, thin and has a large percentage of open spaces, provides good tear strength, burst strength and dimensional stability and retains the advantages of prior art membranes.

The present inventors have developed an ion exchange membrane which incorporates a leno weave fabric, especially if made of low denier yarns, which is a thin fabric, stable under various stresses even if the fabric is of high openness. The leno weave is one in which the warp yarns are arranged in pairs with one twisted around the other between picks of filling yarn as in marquisette. This type of weave prevents slippage and displacement of warp and filling yarns. Similarly, the reinforced membrane is stable during handling and installation, under the forces of shrinkage and expansion inside the electrolyzer, and during disassembly of the cell, allowing a higher percentage of the membrane to be reinstalled and reused.

SUMMARY OF THE INVENTION

The present invention is a reinforced ion exchange membrane, preferably a highly fluorinated ion exchange membrane, in which the reinforcement is made of a leno weave fabric. The fabric is made by leno weaving (a) yarns of a polymer, resistant to chlorine, sodium hypochlorite, and concentrated sodium hydroxide at a temperature of at least 100° C., such as polytetrafluoroethylene, and (b) sacrificial fibers, in the warp, and (c) yarns of a polymer resistant to chlorine, sodium hypochlorite, and concentrated sodium hydroxide at a temperature of at least 100° C., such as polytetrafluoroethylene, in the weft. The fabric preferably has about one sacrificial fiber in the warp for each permanent, resistant fiber in the warp, and substantially all of the sacrificial fibers are paired with resistant fibers.

Preferably the resistant yarns are perfluorinated and have an aspect ratio of 1–20, preferably 5–10. The fabric openness should be 40–95%, preferably 60–95%, and denier of the permanent yarn should be 5–400, preferably 25–200.

The reinforced membranes of this invention overcome the inherent problems of membranes reinforced with a plain weave fabric having sacrificial fibers and a leno weave fabric. The reinforced membranes simultaneously provide the advantages of both leno weave and plain weave fabrics. The reinforced membrane has good dimensional stability and the order and arrangement of the yarns is maintained during handling. It is possible and desireable to use permanent resistant yarns in the warp having the same denier as the permanent resistant fibers in the weft. The resulting membrane then has the same physical properties in both directions. The fabric and the resulting membrane is strong and thin. Because the sacrificial fibers do not significantly outnumber the permanent fibers, the incidence of channels is less. Moreover, the channels are not interconnected and run in only one direction, thereby preventing leakage from one channel to the next. As a result, the membrane has less undesirable void space and is less likely to leak at the edges. Moreover, in the inventive membrane, the sacrificial fibers are intimately associated with permanent fibers, which also tends to reduce the incidence of empty channels of void space when the sacrificial fibers are removed.

A process for the electrolysis of an alkali metal chloride using a highly fluorinated ion exchange membrane reinforced with the leno weave fabric is also provided.

FIGURES

DETAILS OF THE INVENTION

The present invention is a reinforced ion exchange membrane, preferably a highly fluorinated ion exchange membrane, in which the reinforcement is made of a leno weave fabric. The fabric is made by leno weaving (a) yarns of a polymer, resistant at temperatures of intended use to chemicals to which the membrane is to be exposed, preferably resistant to chlorine, sodium hypochlorite, and concentrated sodium hydroxide at a temperature of at least 100° C., such as yarns of polytetrafluoroethylene, and (b) sacrificial fibers in the warp, and (c) yarns of a polymer resistant at temperatures of intended use to chemicals to which the membrane is to be exposed, preferably resistant to chlorine, sodium hypochlorite, and concentrated sodium hydroxide at a temperature of at least 100° C., such as yarns of polytetrafluoroethylene, in the weft.

Figure 1:
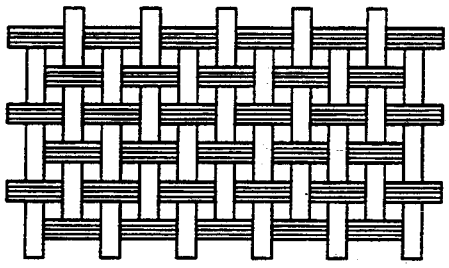
FIG. 1 depicts a plain-weave fabric.
Figure 2:
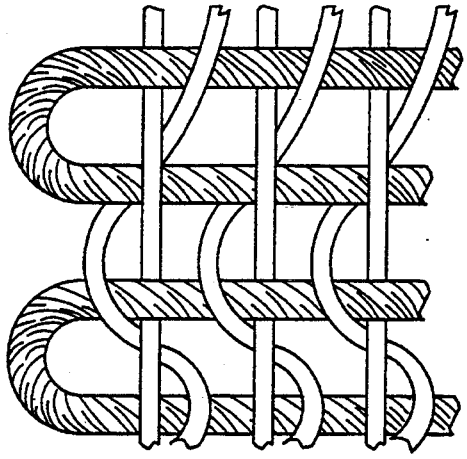
FIG. 2 depicts a leno-weave fabric.
Figure 3:
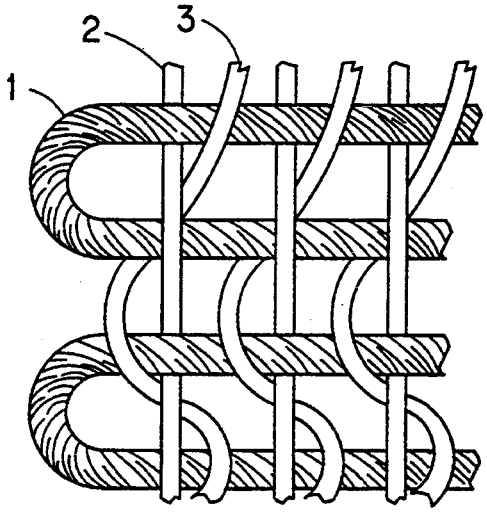
FIG. 3 depicts a leno-weave fabric of the present invention.
Figure 4:
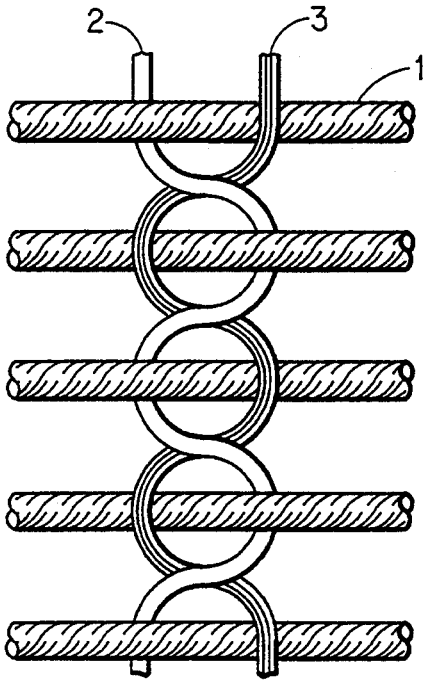
FIG. 4 depicts an alternate embodiment of the present invention.
Figure 5:
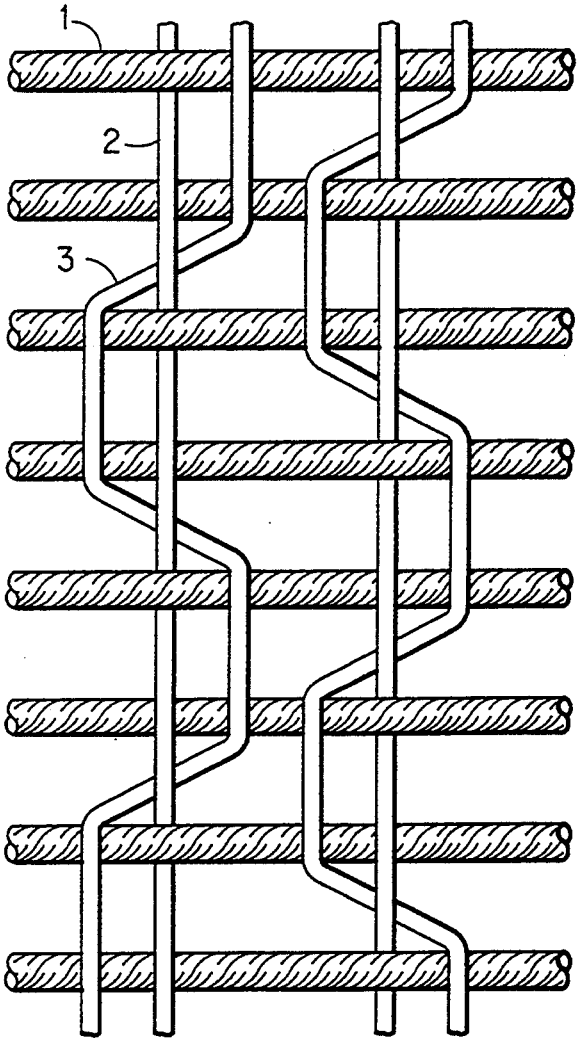
FIG. 5 depicts an alternate embodiment of the present invention.

In order to provide the desired mechanical strength and to minimize cell voltage during operation, sacrificial yarns are included in the leno weave fabric along with permanent, corrosion-resistant yarns. FIG. 3 depicts the leno weave fabric of the present invention. Threads 1 and 2 are made from corrosion-resistant polymers and thread 3 is a sacrificial yarn. FIG. 4 depicts an alternate embodiment of the present invention wherein the threads are woven in a half-cross leno weave. Threads 1 and 2 are made from corrosion-resistant polymers and thread 3 is a sacrificial yarn. FIG. 5 depicts the preferred embodiments of the present invention. Threads 1 and 2 are made from corrosion-resistant polymers and thread 3 is a sacrificial yarn. The sacrificial thread 3 is woven over more than one resistant yarn in the weft, which ensures that the resistant threads shall remain woven when the sacrificial threads are removed. FIG. 5 depicts a fabric in which the sacrificial threads extend over two resistant threads and under two resistant threads, then over two resistant threads, etc. After the fabric has been laminated into a membrane, the sacrificial yarns can be removed by dissolving them in a suitable liquid or by hydrolyzing them to small fragments which can be removed from the membrane. The concept of the use of sacrificial yarns in bimembranes (membranes having layers of two different polymers) and suggestions for what materials to use for sacrificial yarns and for dissolving the sacrificial yarns are disclosed in U.S. Pat. No. 4,437,951. After the sacrificial yarn is removed from the leno weave fabric, the fabric has the character of a plain weave with channels in the membrane in the sites originally occupied by the threads.

The resistant polymer used to make the reinforcing yarns must be resistant for an indefinite time to the chemical action of the chemicals present in a chloralkali cell at its operating temperature, which often approaches 100° C. To achieve this, it is suitable to use a highly fluorinated polymer, in which at least 90% of the carbon-hydrogen (C—H) bonds have been replaced with C—halogen bonds. The halogen is preferably chlorine (Cl) or fluorine (F), and more preferably is F. Most preferably, there are no C—H bonds in the polymer, because perhalogenated and especially perfluorinated polymers have the best resistance to heat and chemicals. It is customary to use a fabric made of fluorocarbon resin such as polytetrafluoroethylene ("PTFE") or a melt-processable copolymer of tetrafluoroethylene with hexafluoropropylene or with perfluoro (propyl alkyl ether) with alkyl being 1 to 10 carbon atoms such as perfluoro (propyl vinyl ether).

Suitable threads of PTFE having substantially rectangular cross-section can be made by lubricant-assisted PTFE sheet extrusion, slitting and stretching, or can be made by lubricant-assisted extrusion of flat PTFE filament stretching, e.g., as described as in U.S. Pat. No. 2,776,465.

Reinforcement yarn made from chlorotrifluoroethylene polymers are also useful. It is also possible to use oriented, hydrolyzed yarns of a fluorinated, preferably perfluorinated, copolymer containing functional groups such as —$SO_3Na$ or —COONa after hydrolysis. The use of such ion exchange yarns is disclosed in U.S. Pat. No. 4,964,960.

So as to have adequate strength in the leno weave fabric before lamination, and in the membrane after lamination, the reinforcement threads should be of 40 to 600 denier, preferably 100 to 300 denier (denier is g/9000 m of thread). The threads in the warp and the weft preferably have the same denier. However, threads of such denier having a typically, round cross section, give membranes which are less satisfactory because they are too thick, especially at the thread junctions where the crossover of threads thickens the reinforcing to twice the tread thickness, thereby requiring use of layers of fluorinated polymer film of adequate thickness to preclude leaks; the overall effect is a thickness which results in operation at relatively high voltage.

The yarns used in making the fabric of the present invention may be fibrids, fibrils, monofilaments, multifilaments, or slit film. Although the configuration of the yarn is not limiting, typical suitable cross-sectional shapes include round, rectangular, oval and elliptical. Rectangular members can be in the form of thin narrow ribbon slit or slit and drawn from film, or can be extruded, in which case the corners may be rounded. Oval, elliptical, and other shapes or specialized cross-sections can be extruded or made by calendering fiber or yarn. It is also possible to calender a fabric to provide the required aspect ratio.

The overall thickness of the fabric and, therefore, of the membrane can be minimized by using oval or rectangular cross-sectional yarns in making the fabric. The degree of rectangularity is defined as aspect ratio, or the ratio of the long to the short dimension of the cross section of the yarn. In accordance with the preferred mode of the invention, fabric whose reinforcement members have the specified denier, but which also have a cross-sectional shape which is noncircular and which has an aspect ratio in the range of 2 to 20, preferably in the range of 4 to 10, are used.

Oblong or rectangular cross-sections, if suitably oriented to the membrane, make it possible to get more reinforcing action with a thinner overall membrane. Even with a cloth or mesh of fluorocarbon yarns, it is preferred not to have the yarn or fiber in the yarn penetrate the surface of the membrane on the cathode side. The fabric employed may be calendered before lamination to reduce its thickness, or it may be heatset to reduce dimensional change during lamination. In a multilayer membrane, described below, the fabric may be in the sulfonate or carboxylate layer, or in both, but is more often in the sulfonate layer, which is usually thicker. As the web of support material should have a thickness in the range of 25 to 125 microns (1 to 5 mils), preferably 50 to 75 microns (2 to 3 mils), the reinforcing members should have a thickness of 12 to 63 microns (0.5 to 2.5 mils), preferably 25 to 38 microns (1 to 1.5 mils).

The leno weave fabric should have a thread count in the range of 1.6 to 16 reinforcement threads/cm (4 to 40 threads/inch) in each of the warp and weft. A thread count in the range of 3 to 8 reinforcement threads/cm is preferred.

The sacrificial yarns of the leno weave fabric are yarns which are not resistant to chemicals to which the membrane will be exposed during use at temperatures of intended use. The sacrificial yarns or fibers may be threads of any of a number of suitable substances, either natural or synthetic. Suitable substances include cotton, linen, silk, rayon, polyamides such as 6—6 nylon, polyesters such as polyethylene terephthalate, and acrylics such as polyacrylonitrile. The cellulosic and polyester substances are preferred. The primary requirement of the sacrificial fibers is their removal without a substantial detrimental effect on the polymer matrix. With this proviso, the chemical makeup of the sacrificial fibers is not critical. In similar fashion the manner of removal of the sacrificial fibers is not critical so long as this removal does not interfere with the ion exchange capability of the final polymer in the ion permeable separator. For purposes of illustration, removal of sacrificial fibers of a cellulosic material such as rayon may be done with sodium hypochlorite.

The sacrificial members, e.g., DACRON® polyamide (commercially available from E.I. du pont de nemours and Company), rayon or polyester threads or narrow ribbon slit from regenerated cellulose film, can suitably be of about 10 to 100 denier, preferably 20 to 80. They can have an aspect ratio in the range of 1 to 20, i.e., can have a rectangular, oval or elliptical cross section, or if of low enough denier, can be of aspect ratio 1, i.e, circular in cross section. As in the case of the reinforcement threads, the sacrificial threads should have a thickness of 12 to 63 microns, preferably 25 to 38 microns.

The ratio of sacrificial threads to permanent reinforcement threads in the warp of the leno weave fabric should be in the range of about 3:1 to 0.5:1. Preferred ratios of sacrificial to reinforcement fibers in the wrap are about 1:1.

The reinforcement fabric can be made such that the threads of high aspect ratio present are either twisted or not twisted, and if twisted, a suitable number of twists, so that a high aspect ratio is maintained, is up to about 12, preferably 2 to 12.

The reinforcement leno weave fabric should be such that, after later removal of the sacrificial threads, the fabric will have an openness of at least 40–95%, preferably at least 65–95%. By "openness" is meant the total area of the windows in relation to the overall area of the fabric, expressed as a percentage.

Removal of the sacrificial fibers from the membrane can variously be done before, during or after conversion of the original membrane in melt-fabricable form to the ion exchange membrane, preferably after such conversion. It can be done during said conversion when the sacrificial members are of a material which is destroyed by the hydrolysis bath employed for said conversion; an example is hydrolysis of a nylon polymer by caustic. It is possible but not preferable to remove sacrificial fibers before said conversion, e.g., in the case of DACRON® polyester or rayon sacrificial members by treatment with an aqueous sodium hypochlorite before said conversion, in which case there is prepared a membrane wherein the sacrificial fibers have been removed and the functional groups of the polymer layers are still in —COOR and —$SO_2W$ form (where R is a lower alkyl and W is F or Cl). Preferably, hydrolysis can first be done; in which case, the functional groups are converted to —COOR and —$SO_3H$ or salt thereof; in which case, there is prepared a membrane in ion exchange form which still contains the sacrificial fibers; the sacrificial fibers are subsequently removed, which, in the case of rayon or other cellulosic fibers, or polyester fibers, in a membrane used in a chloroalkali cell, can be done by action of hypochlorite ions formed in the cell during electrolysis. Following removal of the sacrificial fibers, the fabric has in many respects the character of a plain weave fabric.

The channels have a nominal diameter in the range of 1 to 50 microns. This nominal diameter is the same as that of the sacrificial fiber, the removal of which results in formation of the channel. It is believed that the actual diameter of a channel can change, shrinking or collapsing when the membrane is dehydrated, and swelling when the membrane itself is swollen. Ordinarily the channels left by removal of sacrificial threads of a fabric are in the range of 10 to 50 microns in diameter.

The multi-layer membranes of the invention are preferably prepared so that the fabric does not penetrate through the first layer of fluorinated polymer which has carboxyl functionality, but lies at least predominantly in another layer of fluorinated polymer which has carboxyl or sulfonyl functionality, and preferably in the second layer of fluorinated polymer which has carboxylic or sulfonyl functionality, which second layer is ordinarily a surface layer of the membrane.

In order to minimize the overall thickness of the reinforced membrane, the fabric should be as thin as possible. The fabric thickness can be minimized by calendering the fabric before it is laminated into the membrane structure. When the fabric is thin, it is possible to make the overall thickness of the membrane smaller without having the yarns penetrate the membrane surface. This not only saves ion exchange resin, but decreases the cell voltage.

The ion exchange membranes are typically made from layers of carboxylic polymers and/or sulfonyl polymers. The carboxylic polymer or polymers of which the membrane layer in contact with the catholyte are well known in the art and are described in U.S. Pat. No. 4,437,951. The polymer is usually made have a fluorinated hydrocarbon backbone chain to which are attached side chains carrying certain functional groups hydrolyzable in the alkaline medium to carboxylate groups, such as nitrile or particularly ester groups. Those polymers include, e.g., those containing the $$-(OCF_2\underset{\underset{Y}{|}}{C}F)_n-O-CF_2-W$$

side chains, where Y is F or $CF_3$; n is 0, 1, or 2; and W is COOR or —CN, where R is lower alkyl. Such polymers are described in U.S. Pat. No. 4,138,246. Among these polymer, those with n=1 and Y=$CF_3$ are preferred.

Preferably, the membrane used in the electrolytic cells according to the process of this invention comprises at least two layers, at least one layer in contact with the anolyte having pendant sulfonyl groups.

A membrane having at least one layer of a copolymer having sulfonyl groups in melt-fabricable form and a layer of a copolymer having carboxyl groups in melt-fabricable form, such as made by coextrusion, can be used as one of the component films in making the membrane to be used in the process of the present invention. Such a laminated structure will be occasionally referred to herein as a bimembrane. Bimembranes are well known in the art.

The sulfonyl polymer of which at least one membrane layer in contact with the anolyte according to this invention are well known in the art are described in U.S. Pat. No. 4,437,951. The polymer can be a fluorinated polymer with side chains containing the group —$CF_2CFR'SO_2X$, wherein R' is F, Cl, $CF_2Cl$ or a $C_1$ to $C_{10}$ perfluoroalkyl radical, and X is F or Cl, preferably F. Ordinarily, the side chains will contain —$OCF_2CF_2CF_2SO_2X$ or —$OCF_2CF_2SO_2F$ groups, preferably the latter. The perfluorinated polymers are preferred.

Polymers containing the side chain $$-O(CF_2\underset{\underset{CF_3}{|}}{C}FO)_kO-(CF_2)_j-SO_2F$$

where k is 0 or 1 and j is 3, 4, or 5, may be used. These are described in U.S. Pat. No. 4,329,435. Polymers containing the side chain —$CF_2CF_2SO_2X$ are described in U.S. Pat. No. 3,718,627.

Preferred polymers contain the side chain —$(OCF_2CFY)_r$—OCF—$2CFR'SO_2X$, where R', Y, and X are as defined above; and r is 0, 1, 2, or 3. Some of those polymers are described in U.S. Pat. No. 3,282,875. Especially preferred are copolymers containing the side chain $$-OCF_2\underset{\underset{CF_3}{|}}{C}FOCF_2CF_2SO_2F$$

The sulfonyl polymers may be blends of sulfonyl polymers. The carboxyl polymers may be blends of carboxyl polymers. The membrane may comprise a blend of sulfonyl and carboxyl polymers.

Polymerization can be carried out by the methods described in the above references.

The copolymers used in the manufacture of membrane layers used in the process of the present invention should be of high enough molecular weight to produce films which are self-supporting in both their melt-fabricable (precursor) form and in the hydrolyzed ion exchange form. It is in fact preferred to use in the electrolysis of alkali metal chlorides process a carboxyl/sulfonyl bimembrane, and it is possible for the sulfonyl layer to have an equivalent weight lower than that of the carboxyl layer by at least 50 units. It is also possible to use an all-carboxyl membrane with a layer of lower equivalent weight on the anolyte side.

The membrane used in this invention may also comprise multiple layers such as a three layer membrane as follows:

a) on the catholyte side, a carboxyl layer of a 5–50 micrometer thickness, preferably 20–40 micrometers, preferably with an equivalent weight suitable to provide a water transport of 3.0–4.0 moles of water per gram atom of sodium, b) in the middle, an optional carboxyl layer with a lower equivalent weight and a thickness in the same range, as that of (a), and c) on the anolyte side, a sulfonyl layer of a 50–250 micrometer thickness, preferably 750–100 micrometers.

Another three-layer membrane used in J 63/310988 to make concentrated NaOH has a carboxyl layer sandwiched between two sulfonic layers.

Membranes usually have an overall thickness of 50–300 micrometers, especially 125–200 micrometers.

The customary way to specify the structural composition of films or membranes in this field is to specify the polymer composition, ion-exchange capacity or equivalent weight, and thickness of the polymer films in melt-fabricable form, from which the membrane is fabricated. This is done because the measured thickness varies depending on whether the membrane is dry or swollen with water or an electrolyte, and even on the ionic species and ionic strength of the electrolyte, even though the amount of polymer remains constant.

For use in electrolysis of brine, the membrane should have all of the functional groups converted to ionizable functional groups. These will be sulfonic acid and carboxylic acid groups, or preferably sodium salts thereof. When the term "sulfonic ion exchange groups" or "sulfonyl" is used, it includes not only the sulfonic acid group but particularly the sodium salts thereof. Similarly, the term "carboxylic ion exchange groups" or "carboxyl" means the carboxylic acid group and particularly the sodium salts thereof.

Conversion to ionizable functional groups is ordinarily and conveniently accomplished by hydrolysis with acid or base, such that the various functional groups described above in relation to the melt-fabricable polymers are converted respectively to the free acids or the sodium salts thereof. Such hydrolysis can be carried out by methods well known in the art.

The equivalent weight of the carboxyl layer should be 500–1400, preferably 670–1250, most preferably 770–1100. Higher equivalent weights may be used for thin carboxyl layers, while lower equivalent weights may be used for carboxyl polymers with short pendant side chains containing the terminal carboxyl group.

The equivalent weight of the sulfonate polymer should be low enough to give low membrane resistance or low electrolysis voltage, but not so low as to give a membrane which is too soft, sticky or gelatinous when wet for convenient handling and installation in a cell. In the case where the side chain is $—O—CF_2—CF(CF_3)—O—CF_2—CF_2OSO_3H$ or its salt, the equivalent weight should be 700–1500, preferably 800–1300, and most preferably 900–1100. Lower equivalent weights may be used when the side chain containing the sulfonate group is short. Preferably, the sulfonic acid layer will have an equivalent weight lower than that of the adjacent carboxyl layer.

The membrane or bimembrane may be used flat in various known filter press cells, or may be shaped around an electrode. The latter is especially useful when it is desired to convert an existing diaphragm cell to a membrane cell in order to make higher quality caustic.

Membranes can be swelled with polar solvents (such as lower alcohols or ester, tetrahydrofuran, or chloroform) and then dried, preferably between flat plates, to improve their electrolytic performance. Before mounting in commercial cell support frames, which may be 1–5 meters on a side, the membrane can be swelled so that it will not wrinkle after it is clamped in the frame and exposed to electrolytic fluids. Among the swelling agents that can be used are water, brine, caustic, lower alcohols, glycols, or mixtures thereof. See, for example, U.S. Pat. No. 4,595,476. One of the advantages of the present invention is that membrane defects such as crimps, which lead to pinholes, are less likely to develop during handling the wet preswelled membrane.

The configuration of the cell, electrodes and other associated equipment are not critical to this invention. The process for operating the electrochemical cell is also not critical and is well known in the art. The cell can have two or three compartments, or even more. If three or more compartments are used, the membrane is commonly placed next to the cathode compartment, and the other dividers may be porous diaphragms or membranes based on polymers having pendant side chains with terminal $—CF_2—SO_3Na$ groups only. The cells may be connected in series (so-called bipolar cells) or in parallel (so-called monopolar cells).

The membrane may be disposed horizontally or vertically in the cell, or at any angle from the vertical. Any of the conventional electrodes or electrode configurations may be used. A commercially available anode known as a dimensionally-stable anode (or DSA) is one of those that are suitable. The anode may also be a "zero-gap" anode, against which the membrane is urged and which anode is permeable to both liquids and gases. The cathode should be resistant to corrosion by the catholyte, resistant to erosion, and preferably will contain and electrocatalyst to minimize hydrogen overvoltage. The cathode may be a "zero-gap" cathode, against which the membrane is urged and which cathode is permeable to both liquids and gases. The electrolytic cell may be operated by methods well known in the art.

Brine electrolysis is normally carried out at a temperature above 70–110° C., preferably 80–100° C. At temperatures above 100° C., pressure cells should be used.

The membranes described herein can be used as a substrate to carry an electrocatalyst composition on either surface or both surfaces thereof, the resulting article being a composite membrane/electrode.

Such electrocatalyst can be of a type known in the art, such as those described in U.S. Pat. Nos. 4,224,121, 3,134,697; and 4,210,501. Preferred cathodic electrocatalysts include platinum black, Raney nickel and ruthenium black. Preferred anodic electrocatalysts include platinum black and mixed ruthenium and titanium oxides or iridium oxides.

Composite structures having non-electrode layers thereon can be made by various techniques known in the art, which include preparation of a decal which is then pressed onto the membrane surface, spray application of a slurry in a liquid composition (for example, dispersion or solution) of the binder followed by drying, screen or gravure printing of compositions in past form, hot pressing of powders distributed on the membrane surface, and other methods disclosed in the art. Such structures can be made by applying the indicated layers onto membranes in melt-fabricable form, and by some of the methods onto membranes in ion-exchange form; the polymeric component of the resulting structures when in melt-fabricable form can be hydrolyzed in known manner to the ion-exchange form.

The ion exchange membrane reinforced with leno-weave fabric according to the present invention have excellent dimensional stability and excellent performance during use in an electrolytic cell or fuel cell.

We claim:

1. A membrane comprising at least one highly fluorinated ion exchange resin reinforced with a leno weave yarn system comprising (a) in the warp (i) resistant yarns made from at least one polymer resistant at temperatures of intended use to chemicals to which the membrane is to be exposed during said use, and (ii) sacrificial yarns; and (b) in the weft, resistant yarns made from at least one polymer resistant at temperatures of intended use to chemicals to which the membrane is to be exposed during said use and no sacrificial yarns.

2. The membrane of claim 1 wherein the ratio of sacrificial yarns to resistant yarns in the warp is in the range of 3:1 to 0.5:1.

3. The membrane of claim 2 wherein the ratio of sacrificial yarns to resistant yarns is about 1:1 and substantially all of the sacrificial yarns are paired with a resistant yarn.

4. The membrane of claim 1 wherein ion exchange resin is a cation exchange resin and the resistant yarns in both the warp and the weft comprise a polymer which is resistant to chlorine, sodium hypochlorite, and concentrated sodium hydroxide at 110° C.

5. The membrane of claim 1 wherein the polymer of which the resistant yarns are made is highly fluorinated.

6. The membrane of claim 5 wherein the polymer of which the resistant yarns are made is perfluorinated.

7. The membrane of claim 5 wherein the polymer of which the resistant yarns in the warp and the weft are made is a homopolymer or copolymer of tetrafluoroethylene.

8. The membrane of claim 1 where in the resistant yarns are 40 to 600 denier and have an aspect ratio of 1–20.

9. The membrane of claim 8 wherein the resistant yarns are 50 to 300 denier and have an aspect ratio of 4–10.

10. The membrane of claim 1 wherein the fabric openness is 40–95% and the denier of the sacrificial yarns is 20–100.

11. The membrane of claim 10 wherein the fabric openness is 60–95% and the denier of the sacrificial yarn is 40–60.

12. The membrane of claim 1 wherein the membrane is a bimembrane.

13. The membrane of claim 1 wherein the sacrificial yarn is made from cotton, linen, silk, polyamides, polyesters, cellulosic material or mixtures thereof.

14. An improved electrolytic cell which comprises an anode, an anode compartment, a cathode, a cathode compartment and an ion exchange membrane which separates said compartments, the improvement comprising use of the membrane of claim 1.

* * * * *